US006585063B2

(12) United States Patent
Larsen

(10) Patent No.: US 6,585,063 B2
(45) Date of Patent: Jul. 1, 2003

(54) MULTI-STAGE DIFFUSER NOZZLE

(75) Inventor: James L. Larsen, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/736,613

(22) Filed: Dec. 14, 2000

(65) Prior Publication Data

US 2002/0112889 A1 Aug. 22, 2002

(51) Int. Cl.[7] ..... E21B 7/00; E21B 10/18
(52) U.S. Cl. ..... 175/57; 175/340
(58) Field of Search ..... 175/57, 65, 424, 175/340, 393, 429

(56) References Cited

U.S. PATENT DOCUMENTS

| | | | | | |
|---|---|---|---|---|---|
| 2,901,223 | A | * | 8/1959 | Scott | 175/333 |
| 3,070,182 | A | * | 12/1962 | Runte | 175/339 |
| 3,087,558 | A | * | 4/1963 | Dougherty, Jr. | 175/317 |
| 3,823,789 | A | * | 7/1974 | Garner | 175/340 |
| 4,185,706 | A | * | 1/1980 | Baker, III et al. | 175/340 |
| 4,187,921 | A | * | 2/1980 | Garner | 175/340 |
| 4,189,014 | A | * | 2/1980 | Allen et al. | 175/339 |
| 4,239,087 | A | * | 12/1980 | Castel et al. | 175/340 |
| 4,378,853 | A | * | 4/1983 | Chia et al. | 175/340 |
| 4,392,534 | A | | 7/1983 | Miida | 175/340 |
| 4,542,798 | A | | 9/1985 | Madigan | 175/340 |
| 4,619,335 | A | * | 10/1986 | McCullough | 175/340 |
| 4,673,045 | A | * | 6/1987 | McCullough | 175/339 |
| 4,687,067 | A | * | 8/1987 | Smith et al. | 175/340 |
| 4,690,229 | A | * | 9/1987 | Raney | 175/325.4 |
| 4,703,814 | A | | 11/1987 | Nguyen | 175/393 |
| 4,759,415 | A | * | 7/1988 | Pessier | 175/340 |
| 4,784,231 | A | * | 11/1988 | Higgins | 175/340 |
| 4,856,601 | A | * | 8/1989 | Raney | 175/393 |
| 5,029,656 | A | * | 7/1991 | Ivie et al. | 175/340 |
| 5,293,946 | A | * | 3/1994 | Besson et al. | 175/424 |
| 5,495,903 | A | * | 3/1996 | Griffin et al. | 175/424 |
| 5,601,153 | A | * | 2/1997 | Ensminger et al. | 175/340 |
| 5,669,459 | A | * | 9/1997 | Larsen et al. | 175/340 |
| 5,775,443 | A | * | 7/1998 | Lott | 175/340 |
| 5,785,258 | A | * | 7/1998 | Akin et al. | 175/424 |
| 5,853,055 | A | * | 12/1998 | Siracki et al. | 175/340 |
| 5,921,476 | A | * | 7/1999 | Akin et al. | 175/424 |
| 6,065,683 | A | * | 5/2000 | Akin et al. | 175/424 |

FOREIGN PATENT DOCUMENTS

| | | | | |
|---|---|---|---|---|
| EP | 0669449 A2 | | 8/1995 | |
| GB | 2277758 A | | 11/1994 | |
| GB | 2301126 A | * | 11/1996 | E21B/10/18 |
| RU | 2001231 C | * | 10/1993 | E21B/10/18 |
| SU | 1694844 A | * | 11/1991 | E21B/10/18 |

OTHER PUBLICATIONS

United Kingdom Search Report, Application No. GB 0129993.2 dated Jun. 11, 2002, 4 pages.

* cited by examiner

*Primary Examiner*—William Neuder
*Assistant Examiner*—Jennifer H Gay
(74) *Attorney, Agent, or Firm*—Conley Rose P.C.

(57) ABSTRACT

A multi-stage diffuser nozzle for use as a drill bit nozzle jet includes a flow restriction portion upstream of a fludic distributor portion, and also preferably includes a transition region between these two. The flow restrictor communicates with the interior fluid plenum of a drill bit and is used to limit or choke the total flow of drilling fluid by having a relatively small cross-sectional area for fluid flow. The fluidic distributor communicates with the flow restrictor and reduces the exit flow velocities of the drilling fluid as the drilling fluid is ejected from the nozzle by providing a relatively larger cross-sectional area for fluid flow. The fluidic distributor also directs the flow paths of the drilling fluid to locations such as cone surfaces that are prone to bit balling. The transition region is an area that dampens fluid pressure oscillations in the drilling fluid.

44 Claims, 13 Drawing Sheets

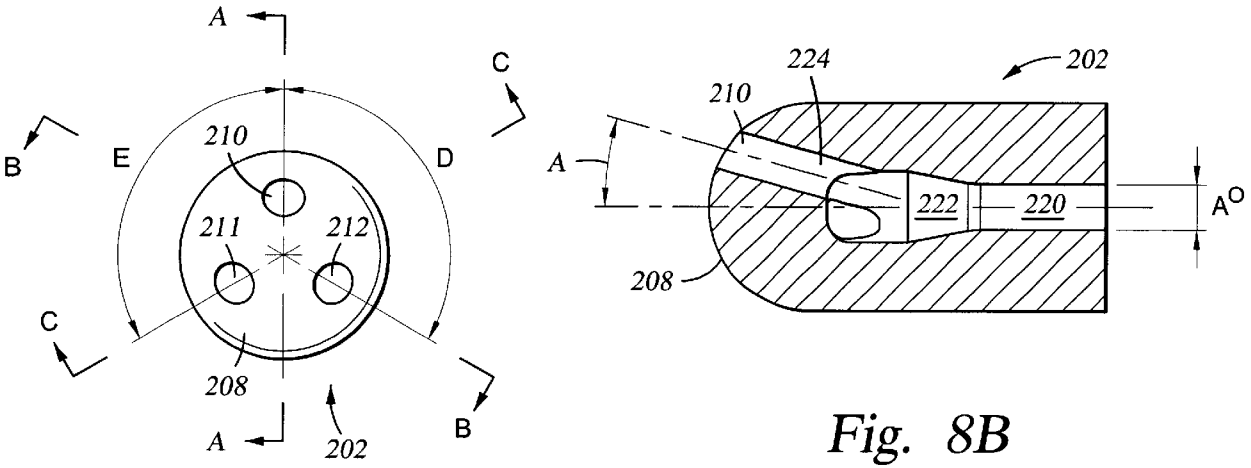
Fig. 8A
Fig. 8B
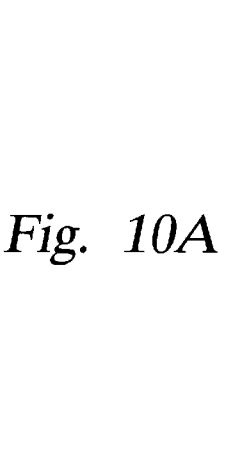
Fig. 10A
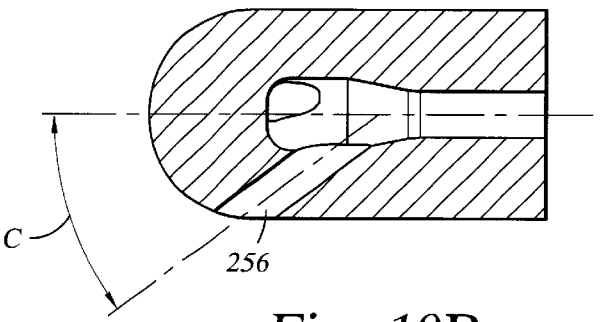
Fig. 10B

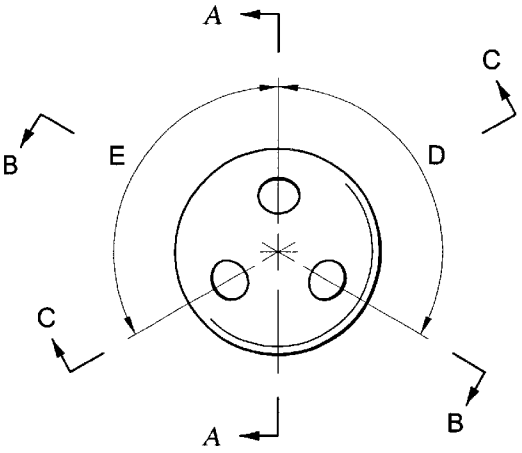
Fig. 13A
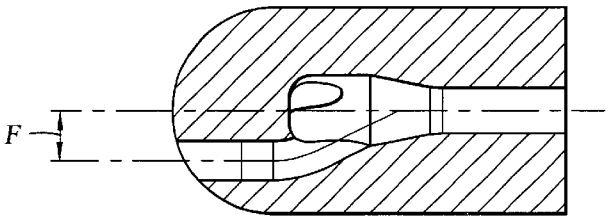
Fig. 13B
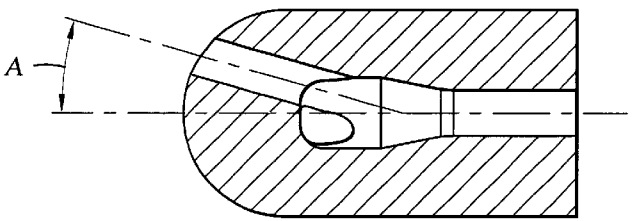
Fig. 13C
Fig. 13D

MULTI-STAGE DIFFUSER NOZZLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Nozzle jets have been used for several years in rotary cone rock bits both in or near the center of the rock bit and around the peripheral edge of the bit to encourage cone cleaning, to enhance removal of debris from a borehole bottom, and to efficiently cool the face of the rock bit.

Rotary cone rock bits are typically configured with multiple jet nozzle exits spaced at regular intervals along the periphery of the bit. High velocity fluid from these jet nozzles impacts the hole bottom and removes rock cuttings and debris. Center jets are also used in rotary cone rock bits for a variety of reasons. These include enhanced cone cleaning, protection against bit balling, and increased total flow of drilling fluid through the drill bit without creating washout problems.

Too much drilling fluid exiting the peripheral jets is believed to encourage undesirable re-circulation paths for drilling fluid at the bottom of the wellbore. In fact, all else being equal, it is thought desirable to have all or nearly all the drilling fluid exit the center jet. However, due to erosion concerns typically only 15 to 30 percent of the total hydraulic fluid (drilling fluid or drilling mud) flow passes through the center jet, with the remainder of the mud being jetted through the peripheral nozzles. In particular, excessive drilling fluid flow through the center jet causes flow erosion at the cutter surfaces, resulting in premature failure of the rock bit. Even when fluid flow through the peripheral jets might be desirable, such as for cleaning the cutting teeth on the roller cones in sticky formations, excessive erosion of the cone shell and other components is a concern.

Many techniques have been used in an effort to optimize the bit hydraulics by modifying the nozzle configuration on the peripheral jets by moving the nozzle closer to the hole bottom, changing the nozzle jet vector, or both. U.S. Pat. Nos. 4,687,067; 4,784,231; 4,239,087; 3,070,182; 4,759,415; 5,029,656; and 5,495,903 teach modifications to the peripheral jets to improve the bit hydraulics, and each is hereby incorporated by reference for all purposes.

Three different types of nozzles are commonly used in center jet applications i.e. the diverging diffuser nozzle, the standard, non-diverging nozzle and the mini-extended nozzle. A less commonly utilized center jet nozzle has multiple discharge ports. Multiple exit nozzles are desirable since they offer the most flexibility to the designer to orient the flow patterns to clean the cutters or to improve borehole cleaning. However, multiple exit nozzles have two major design problems. First, the size for each of the exit ports is necessarily small because the total flow area (TFA) of a multiple exit nozzle is equal to the sum of the exit areas and to keep the total flow to within tolerable limits, the individual exit nozzles are necessarily small. As a result, the jet nozzle is prone to plugging. Second, the small nozzle size does nothing to reduce the exit flow velocity. Even though the flow is redirected, high fluid flow rates through each nozzle pointed toward metal components will likely lead to surface erosion and possible catastrophic failure.

A drill bit is needed that provides more efficient drilling fluid flow from the bottom of the borehole without increased erosion concerns around the drill bit. Ideally, this could be accomplished by a novel jet nozzle design or combination, so that the basic drill bit design would remain unchanged.

SUMMARY OF THE INVENTION

A disclosed embodiment of the invention is a drill bit with one or more attached multi-stage diffuser nozzles. The nozzles of this embodiment include a flow restrictor component distinct from a fluidic distributor component, allowing the selective matching of different sized or shaped flow restrictors and fluidic distributors. The flow restrictor has an internal passage to carry fluid from the liquid plenum of the drill bit, the internal passage including a throat of effective cross-sectional area $A_{0E}$. The fluid distributor, downstream from the flow restrictor, includes a fluid exit region with an effective cross-sectional area $A_{1E}$ greater than $A_{0E}$.

This embodiment of the invention may also include numerous variations. For example, the fluidic distributor may be designed to project drilling fluid toward the hole bottom at a variety of desired angles. To minimize undesired pressure fluctuations in the drilling fluid, a transition region of effective cross-sectional area $A_2$ may be added, either as a distinct component or not. Effective cross-sectional area $A_2$ would therefore be larger than either $A_{0E}$ or $A_{1E}$. The drill bit may also be designed so that the diffuser nozzle is either closer to the longitudinal axis of the bit or the periphery of the bit.

A second embodiment of the invention is a nozzle body which may be manufactured from only a single component. This nozzle body includes a first set of one or more passages at an upper end that, combined, are a first cross-sectional area. It also includes a second set of one or more passages at a lower end that, combined, are a second cross-sectional area, the second cross-sectional area being greater than the first cross-sectional area. In addition, the second set of passages directs at least a portion of the fluid along a vector that is not collinear with the central axis of the nozzle body. Similar to the first embodiment, this embodiment may advantageously include a transition region between the first and second sets of passages, the transition region having a cross-sectional area that is greater than either of the first or second cross-sectional areas. The first and second sets of passages may have a variety of configurations. For example, their cross-sectional areas may vary along their lengths, they may be circular or non-circular, they may direct drilling fluid from exit ports in the fluidic distributor at a variety of angles, they may be straight or curved, etc.

A third embodiment of the invention may be expressed as a method of controlling fluid flow through a drill bit. This method includes lowering the fluid pressure of drilling fluid flowing through a drill bit from an initial pressure (such as that present inside the fluid plenum) to a choke pressure, dampening the fluid pressure oscillations in the drilling fluid, and increasing the fluid pressure to an exit pressure (such as that present in the annulus of the wellbore). The exit pressure is necessarily higher than the choke pressure in this embodiment. The drilling fluid pressure may be lowered to the choke pressure by a first single passage, for example. The drilling fluid pressure may then be raised to the transition pressure by a second passage having a cross-sectional area greater than that of the first single passage. One implementation of this embodiment ensures that the difference between the initial pressure and the transition pressure is greater than the difference of the transition pressure and the exit pressure.

The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIGS. 8A and 8B are bottom and cut-away side views of an alternate multi-stage diffuser nozzle;

FIGS. 10A and 10B are bottom and cut-away side views of yet another alternate multi-stage diffuser nozzle;

FIGS. 13A–13D are bottom and cut-away side views of an alternate multi-stage diffuser nozzle.

DETAILED DESCRIPTION OF THE PREFERRED EMBODIMENT

Figure 1:
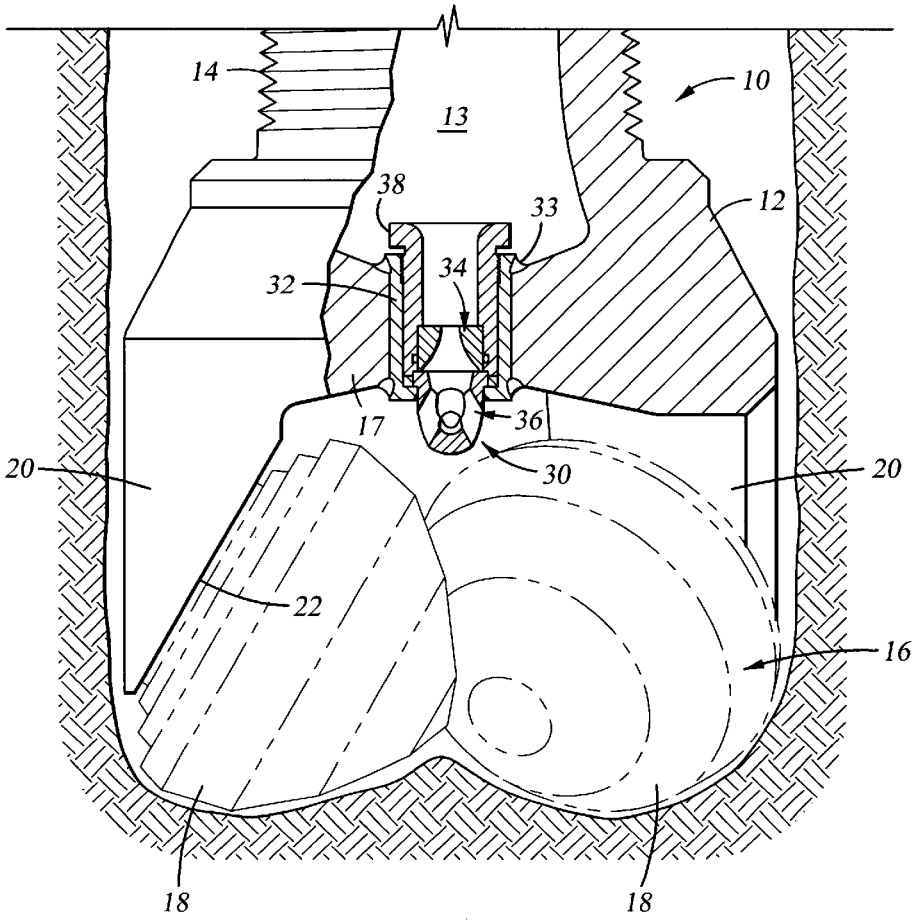
FIG. 1 is a front view of a drill bit including a multi-stage diffuser nozzle.

With reference now to FIG. 1, rotary cone rock bit generally designated as 10 consists of rock bit body 12, pin (upper) end 14 and cutting (lower) end generally designated as 16. A fluid chamber or plenum 13 is formed within bit body 12. The plenum 13 communicates with open pin end 14. Drill bit fluid or "mud" enters the bit body through the pin 14 via a drill pipe attached to the pin (not shown). A dome portion 17 defines a portion of the plenum 13 within body 12. Rock bit legs 20 extend from bit body 12 toward the cutting end 16 of the bit. A cutter cone 18 is rotatably fixed to leg 20 through a journal bearing extending into the cone from the leg backface 22 of the leg 20 (not shown).

Also shown is a multi-stage diffuser nozzle 30 according to a first embodiment of the invention. The multi-stage diffuser nozzle 30 of FIG. 1 generally includes two components, an upper flow restrictor 34 stacked on top of a lower fluidic distributor 36. Fluidic distributor 36 and flow restrictor 34 are inserted through the pin end 14 of the drill bit to a nozzle receptacle region 32. The multi-stage diffuser nozzle 30 is, for example, metallurgically bonded or welded 33 to the dome 17 of the bit 10.

Figure 2:
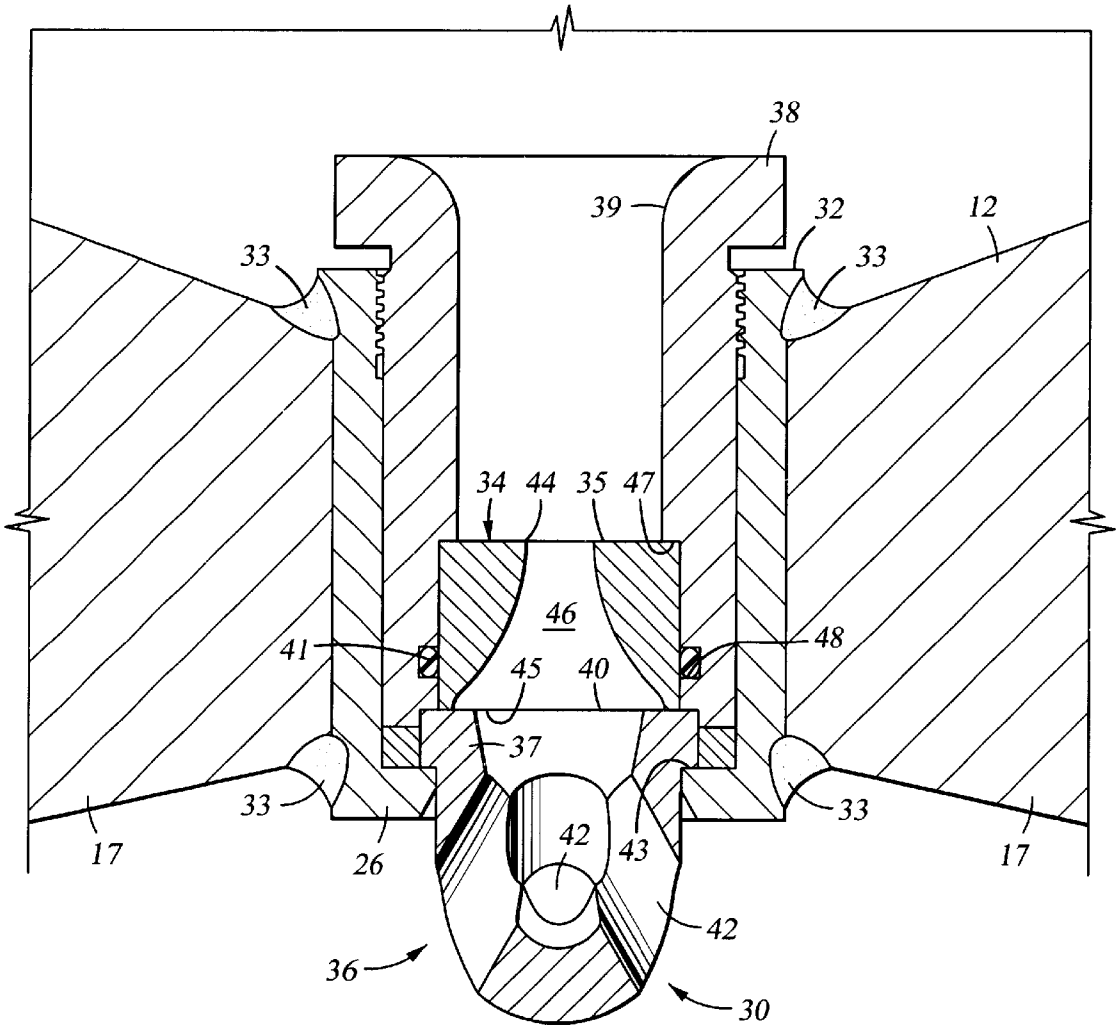
FIG. 2 is a close-up view of FIG. 1.

FIG. 2 is a close-up view of the multi-stage diffuser nozzle 30 in drill bit body 12. Nozzle retention flange 26 of receptacle 32 provides a stop for shoulder 43 of fluidic distributor nozzle body 37. An O-ring 41 is positioned adjacent the periphery of shoulder 43 and an inner wall formed by receptacle 32 prior to insertion of choke nozzle 34 upstream and adjacent to nozzle 36. A nozzle assembly retainer 38 is threaded into nozzle receptacle 32 after the choke nozzle is positioned adjacent to nozzle 36. A nozzle retention shoulder 47 and O-ring groove 48 is formed in the inner wall of the retainer 38. Shoulder 47 seats against body 35 of choke nozzle 34 and the O-ring 41 inhibits leakage of fluid by the choke nozzle. Rounded entrance 39 provides a relatively non-turbulent entry for drilling fluid from chamber 13 formed by bit body 12.

Figure 3:
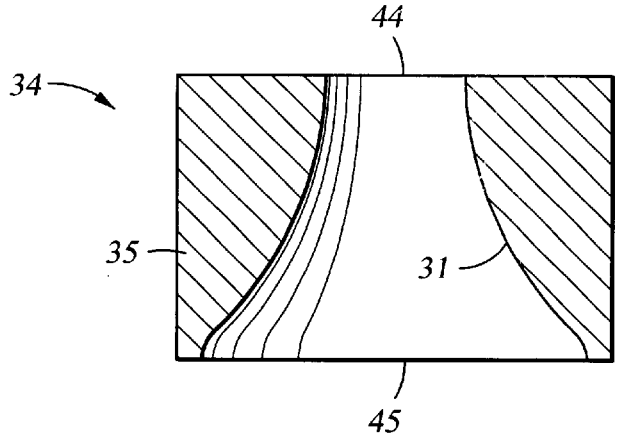
FIG. 3 is a cut-away view of a first flow restrictor.

FIG. 3 depicts the flow restrictor of FIGS. 1 and 2, generally a first nozzle designated as 34. Nozzle 34 is positioned upstream of and adjacent to a fluidic distributor generally designated as 36. The flow restrictor body 35 forms an inlet opening 44 that widely diverges toward outlet opening 45. For the pictured flow restrictor, inlet opening 44 is the location of minimum cross-sectional flow area, a location defined as the throat of the flow restrictor 34. Of course, a similar effect could be obtained by inverting the flow restrictor to make opening 45 an inlet and opening 44 an outlet.

Figure 4:
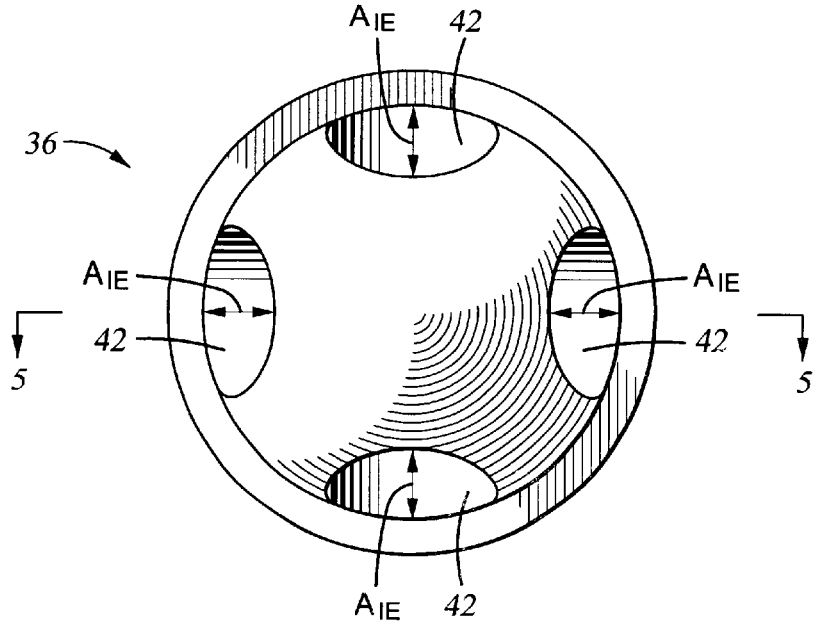
FIG. 4 is a bottom view of a first fluidic distributor.
Figure 5:
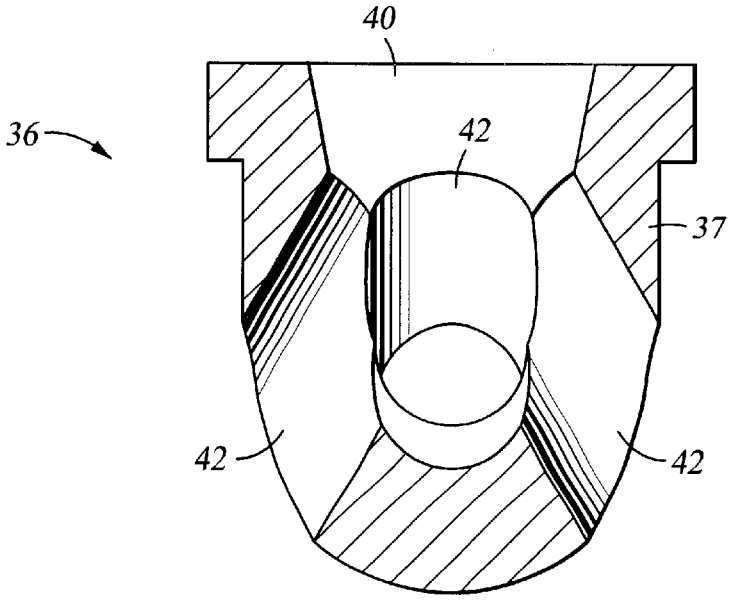
FIG. 5 is a cut-away side view of the first fluidic distributor.

FIGS. 4 and 5 depict the fluidic distributor 36 of FIGS. 1 and 2. FIG. 4 is a bottom view of the fluidic distributor 36, showing four equally-sized exit ports 42 at non-central locations. Thus, multiple exit ports or nozzle outlets 42 formed in body 37 include at least one exit port disposed at an angle to the longitudinal axis of the fluidic distributor 36 (i.e. at a non-central location). FIG. 5 is taken along the cut line 5—5 of FIG. 4. As shown in FIG. 5, fluidic distributor 36 has nozzle body 37 with fluid inlet 40, in addition to exit ports 42. The cross-sectional area of this second nozzle is the minimum cross-sectional area of each exit passage, added together. Consequently, the total summed area of the exit ports 42 is greater than the cross-sectional area at the throat of flow restrictor 34.

Referring to FIGS. 1–5, the combination of the stacked nozzles 34 and 36 provides for independent control of the nozzle system choke mechanism and nozzle exit velocity mechanism. The flow restrictor 34 is used to choke the flow of fluid through the multi-stage diffuser nozzle 30. Its most salient feature therefore is the small cross-sectional area of its throat channel, in this instance the inlet opening 44, and the accompanying pressure drop in the fluid passing through the inlet opening 44. The purpose of the second nozzle 36 is to reduce the drilling fluid exit flow velocities such that they will not erode the cone material (labeled 16 in FIG. 1), as well as to direct the flow paths of the drilling fluid to advantageous locations such as cone surfaces that are prone to bit balling.

The purpose of having a smaller area through the restrictor nozzle 34 than through the distributor nozzle 36 is to force most of the pressure drop across the nozzle system 30 to occur across the restrictor nozzle 34. In other words, a larger pressure drop occurs across the restrictor nozzle 34 than across the distributor nozzle 36, and for the same total pressure drop across the system, a lower pressure drop occurs across distribution nozzle 36. The reduced pressure drop across the distribution nozzle 36 equates to lower nozzle exit velocities for the drilling fluid. Thus, many aspects of the invention can be characterized by a description of the relative pressure drops across a restrictor nozzle 34 and a distributor nozzle 36, or equivalent structure.

The flow rate through the multi-staged nozzle is adjusted by changing the orifice size of the flow restrictor 34. The average volumetric flow rate "Q" of the drilling fluid through an orifice, can be used to calculate the average velocity using the following equation:

$$V = \frac{Q}{A} \tag{1}$$

Where,

Q=Volumetric flow rate through the orifice;

V=Average velocity of the fluid flowing through the orifice; and

A=Effective cross-sectional area of the orifice.

Thus, as a given throat size of the flow restrictor is changed, the total flow through the multi-stage nozzle can be controlled.

The nozzle exit velocity of the drilling fluid is then controlled by the fluidic distributor 36. One aspect of the invention is that the total effective exit area from nozzle 36 is larger than the effective area of the throat in the choke nozzle 34. This lowers the exit flow velocity. Of course, the same principles could be used to increase the exit flow velocity by making the effective cross-sectional area of the flow distributor smaller than the flow restrictor, but bit designers are generally not seeking higher exit flow velocities in the locations where this invention would be proposed for use.

The average velocity of a fluid as it leaves each jet exit hole can then be determined by dividing the total volume flow rate (Q) through the multi-stage nozzle by the total nozzle exit area ($A_{1E}$) at the flow distributor. Because the total flow rate through the flow restrictor must be equal to the flow rate through the fluidic distributor, it can be determined from equation (1) that:

$$\frac{V_O}{V_1} = \frac{A_{1E}}{A_{OE}} \tag{2}$$

where, $V_0$=Velocity of the fluid through the throat in the flow restrictor;

$V_1$=Velocity of the fluid at the exit of the fluidic distributor $A_{0E}$=Effective area of the throat in the flow restrictor;

$A_{1E}$=Effective area of the exit ports of the fluidic distributor.

Because the total effective nozzle exit area, $A_{1E}$, is larger than the effective cross-sectional area of the throat, $A_{0E}$, the velocity of the fluid exiting the multi-stage diffuser nozzle, $V_1$, is lower than the velocity of the fluid as it flows through the throat, $V_0$. In fact, by use of equation (2) the exit velocity can be predictably controlled by increasing or decreasing the total effective nozzle exit area.

To understand the differences between various nozzle designs, the concept of an effective nozzle exit area should be explained. Effective nozzle size or effective cross-sectional area are terms used to describe the comparison of nozzle geometries based upon their pressure drop characteristics under fluid flow conditions. For example, when a given nozzle of certain design is exposed to a particular fluid flow, a specific pressure drop occurs across the nozzle. Another nozzle of the same general design but having a different throat diameter, under the same flow conditions, will produce a different pressure drop than the first nozzle. Thus, two nozzles having the same general nozzle design, under the same flow conditions, produced different pressure drops because of different throat areas. Similarly, two nozzle systems having significantly different internal geometries but the same throat diameter will likely produce different pressure drops, even under the same flow conditions. The energy losses associated with the different internal geometries will cause dissimilar pressure drop responses. For instance, a nozzle design with a smooth, streamlined entrance to the exit orifice will have a lower pressure drop than a nozzle with the same throat diameter but having a sharp 90 degree edge entrance. Consequently, depending on the design of the restrictor nozzle 34 and the distributor nozzle 36, the pressure drops across each may not accurately reflect their relative physical area sizes. In other words, if the design of the flow restrictor 34 is inefficient because of the selected geometry of the nozzle, its physical or measured throat diameter may actually be larger than the distributor nozzle 36. Nonetheless, the pressure drop across the restrictor nozzle 34 would still be greater than that across the distributor nozzle 36, making the restrictor nozzle a choking nozzle.

Figure 14:
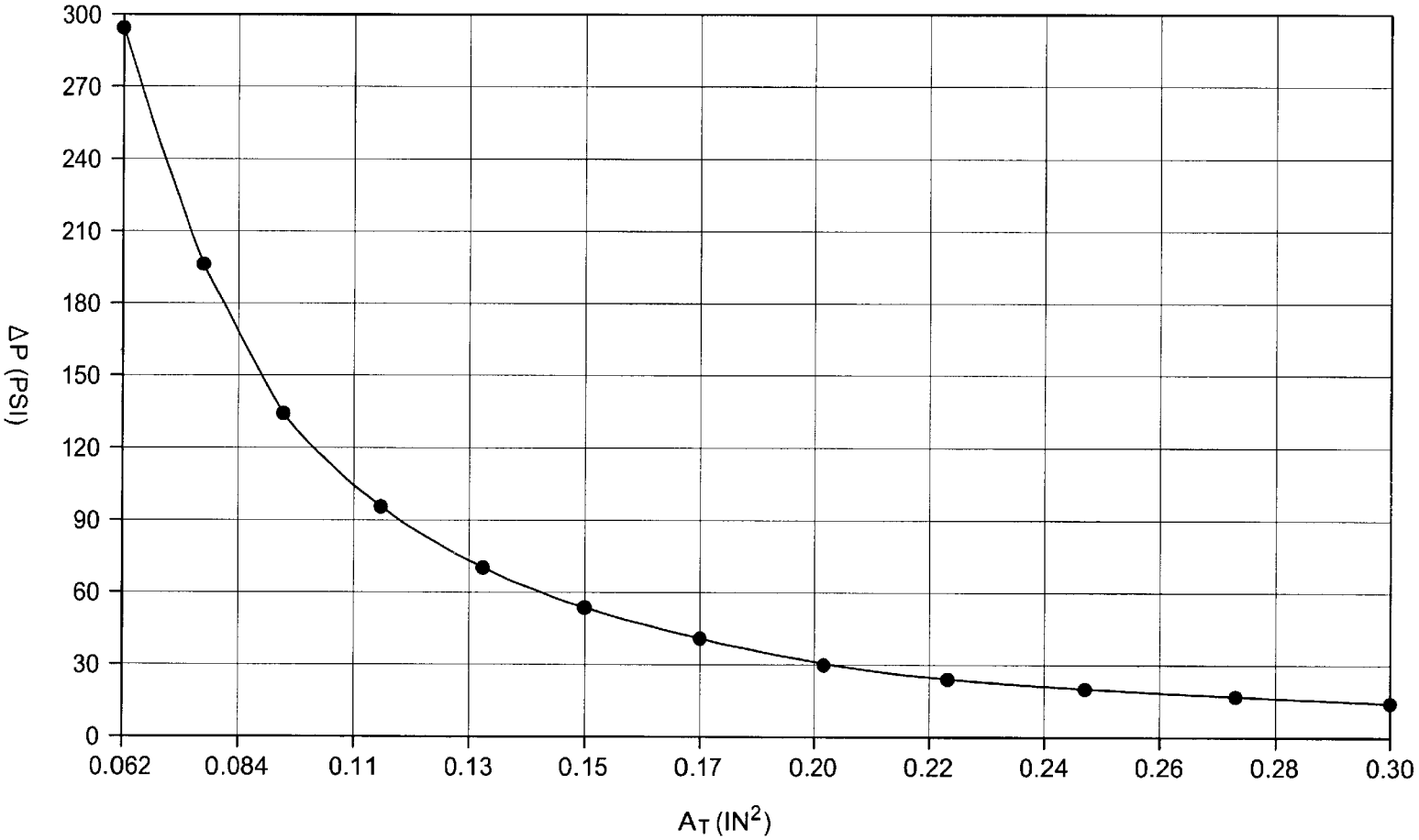
FIG. 14 is a graph of the pressure drop characterization of a nozzle set used as a standard to determine the equivalent nozzle size for a restrictor and distributor nozzle components.

The effective cross-sectional area for a nozzle can be determined by measuring its pressure drop and comparing this pressure drop against a set of measurement made for a standard or baseline nozzle configuration. For example, assume that a nozzle system made with design "A" is considered the standard or baseline nozzle system. Pressure drop measurements could be made for design "A" at a variety of nozzle sizes and flow rates. FIG. 14 shows the pressure drop characteristics for a flow rate of 25 GPM (gallons per minute). A new nozzle system with design "B" having a physical throat diameter of 14/32" (and an area of 0.15 $in^2$) is tested with a flow rate of 25 GPM. If the internal geometries of baseline nozzle system design "A" and nozzle design "B" were generally the same, the expected pressure drop across nozzle design "B" would be approximately 50 PSI. However, due to its different internal geometry, the pressure drop of nozzle design "B" is 70 PSI, which is higher than the baseline standard nozzle having the same physical exit throat area. The effective nozzle area $A_E$ for nozzle design "B" is therefore determined by locating the baseline nozzle area for the measured pressure drop of 70 PSI which in FIG. 14 is approximately 0.13 $in^2$. Thus, while the nozzle from design "B" has a physical throat area of 0.15 $in^2$, and a physical diameter of 14/32 in., based on its pressure drop characteristics, it has an effective nozzle area of 0.13 $in^2$ and effective nozzle diameter of 13/32 in. (assuming circular cross-section) relative to the known standard baseline nozzle system. Through testing and subsequent evaluation, effective nozzle sizes can be determined for both the restrictor nozzle and the distribution nozzle (as well as the transition region explained below).

To further explain, the modified Bernoulli equation as derived in "Introduction to Fluid Mechanics" can be employed to characterize the differences between nozzle geometries. In its basic form the Bernoulli equation illustrates the relationship between velocity, pressure and elevation in a flow stream without consideration of losses incurred due to friction or those resulting from flow separation. In the modified Bernoulli equation, energy losses associated with pipe friction and geometric discontinuities in the flow field are added in to help better model the real situation. Thus the modified Bernoulli equation can be written as follows:

$$\frac{P_1}{\rho g}+\frac{V_1^2}{2g}+z_1=\frac{P_2}{\rho g}+\frac{V_2^2}{2g}+z_2+\sum\frac{fL}{D}\frac{V^2}{2g}+\sum K\frac{V^2}{2g} \quad (3)$$

Where $P_1$, $P_2$=Fluid pressures at the inlet ($P_1$) and the outlet ($P_2$);

$V_1$, $V_2$=Fluid velocities at the inlet ($P_1$) and the outlet ($P_2$);

$Z_1$, $Z_2$=Elevation at the inlet ($z_1$) and the outlet ($z_2$);

ρ=Density of fluid;

g=Acceleration due to gravity;

f=Friction factor;

D=Hydraulic diameter;

L=Length of pipe;

K=Minor loss coefficient.

Generally, in the case of nozzles, the distance L is inconsequential which results in the frictional losses being considered negligible. However, the minor loss contribution can substantially influence the flow stream, especially in regards to nozzles. Depending on their entrance geometries, exit geometries and internal flow path, the pressure drop across nozzles can be significantly different even in cases where the cross-sectional area at the throat and the flow rates are the same. These differences are addressed in the modified Bernoulli equation by the summation of the minor loss coefficients "K". Consequently, two nozzles having the same measured throat diameter but different equivalent or effective nozzle sizes will have different loss coefficients "K".

To illustrate the effect of the area on the overall flow rate, Equation (3) can be simplified with the following assumptions: First, ignore the frictional losses; second, assume the inlet area to the nozzle is much larger than the throat diameter of the nozzle; third, assume that all minor losses occur at the throat velocity; and fourth, ignore any changes in elevation. Using Equation (3), the flow rate through the nozzle can be calculated using the equation:

$$Q=\frac{A_T}{(K+1)^{\frac{1}{2}}}\sqrt{\frac{2\Delta P}{\rho}} \quad (4)$$

Where:

Q=Flow rate through the nozzle

ΔP=Pressure drop across the nozzle $A_T$=Physical cross-sectional area

ρ=Density of fluid

K=Minor loss coefficient

Thus, the flow rate through the restrictor nozzle 34 is directly related to the cross-sectional area of nozzle 34, at its minimum cross-section (i.e. at its throat), which will be referred to as the physically measured throat or $A_T$. It is also related to the square root of 1/(K+1). Thus, as the minor loss coefficient is increased through less efficient geometries, the nozzle becomes more restrictive and reduces the flow rate for a fixed ΔP even though the throat diameter remains constant. In effect, the inefficient geometry creates a nozzle that acts as a smaller, more restrictive, nozzle compared to a well designed streamlined nozzle set. The geometry element $A_T/(K+1)^{0.5}$ of equation 4 is called the restriction factor.

As stated above, the effective nozzle size is determined by comparing the pressure drop of a new nozzle system to some known baseline nozzle system. If the new nozzle is inefficient, the physical throat area $A_{0P}$ is increased until the pressure drop across the nozzle matches that of the standard nozzle system at the same flowrate. This can be done mathematically using the restriction factor. First, assume that we have two nozzle systems, a standard nozzle system and a new nozzle system. For the two systems to have the same or very similar flow rate vs. pressure drop characteristics, the flow restriction factors will be the same or very similar. The nozzle size required for the new nozzle system for an equivalent pressure drop is $$A_{T_N}=A_{T_S}\frac{(K_N+1)^{0.5}}{(K_S+1)^{0.5}} \quad (5)$$

Where $A_{TS}$=standard or baseline nozzle size (physical and effective are the same by definition for the baseline nozzle);

$A_{TN}$=Physical nozzle size of new or compared nozzle;

$K_N$=Minor loss coefficient of new nozzle; and $K_S$=minor loss coefficinet of standard or baseline nozzle At this point, it is easy to see that when the minor loss coefficient $K_N$ of the new nozzle is increased, likely through less efficient geometry, the physical throat area of the new nozzle is increased to maintain an equivalent pressure drop across the nozzle. The effective cross sectional area $A_{TN}$ of the new nozzle system is thus defined as the area, $A_{TS}$, that characterizes the pressure response of the new nozzle system. Thus, for equation 5 to balance, the physical area $A_{TN}$ will be larger or smaller relative to the baseline nozzle to account for the differences in their respective minor loss coefficients $K_N$ and $K_S$. For example, assume that the baseline nozzle has an area $A_{TS}$ of 0.442 square inches and that $K_N$=0.5 and $K_S$=0.05. The physical area $A_{TN}$ of the new nozzle system is calculated to be 0.528 square inches. However, its effective cross sectional area would be 0.442 square inches based on its pressure drop response relative to the baseline system. Alternatively, through testing, the nozzle area $A_{TN}$ of the new nozzle could be incrementally increased or decreased and tested until it had the same pressure drop for the given flow rate as the baseline nozzle. While there are many methods that can be used to characterize the response of a nozzle system, the intent of such characterization for the purposes of this invention is only to establish the portion of the nozzle that restricts the flow and that which distributes the flow at an average lower velocity. The methodology of determining those characteristics is inconsequential.

The effective cross-sectional area of the throat in the flow restrictor portion, $A_{0E}$, depends on the physical cross-sectional area of the throat, the geometry of the entrance to the throat region (sharp corners at the entrance to the throat tend to create an obstacle to fluid flow and therefore the effective cross-sectional area of the throat is smaller than if rounded corners were present at the entrance to the throat) and on certain downstream effects (a smooth downstream transition to a larger opening such as shown in FIG. 7 enlarges the effective cross-sectional area and draws more fluid through the throat than would an abrupt downstream opening). Two flow restrictors 34 having larger effective cross-sectional areas could be stacked together upstream of a fluidic distributor 36 to create the effect of a single flow restrictor having a throat of a smaller effective cross-sectional area. As another example, the flow restrictor may be a pulse jet. Other discontinuities or geometric alterations within the abilities of one of ordinary skill in the art may also be introduced to alter the efficiency, and therefore the effective cross-sectional area, of a structure.

By coupling the flow restrictor nozzle 34 with the fluidic distributor nozzle 36, thereby providing a nozzle design where the total exit area from nozzle 36 is larger than the throat 44 of the flow restrictor nozzle, fluid velocities exiting the two-component multi-stage diffuser nozzle can be reduced significantly. For example, most state of the art nozzles have exit velocities on the order of 200–400 ft/sec. In contrast, the principles of the invention can be used to reduce the nozzle exit velocities to impingement velocities on the cones to 100 ft/sec. or lower. Further, because this embodiment of the invention includes distinct flow restrictor and fluidic distributor components, the choking or flow restriction behavior of the multi-stage diffuser nozzle can easily be controlled independent of the nozzle system exit velocities. In particular, the flow rate through the jet can be controlled independent of the exit flow velocity by selectively matching a particular flow restrictor component with a particular fluidic distributor component just prior to insertion into the drill bit body. This also allows the decision to be made regarding the desired flow rate and exit velocity as late in the drilling job as possible.

In addition, this embodiment of the invention includes a plenum or chamber 46 formed between the choke nozzle 34 and the multiple exit nozzle 36. The plenum 46 is an optional transition region with a volume and design sufficient to slow the fluid flow, dampen fluid oscillations in the fluid flow, and generally steady the flow of fluid passing through the nozzle assembly 30 and out the multiple exits 42 formed by nozzle body 37. Preferably, the transition region has an actual cross-sectional area greater than the actual cross-sectional area of the throat. By significant reduction of the pressure surges and perturbations in the drilling fluid, the transition region helps to keep actual flow velocities at the exit ports close to the average flow velocity, and helps ensure that the drilling fluid is properly distributed among the exit ports of the multi-stage diffuser nozzle according to their size. Thus, although a transition region is not essential to the invention, it is a desirable feature of a multi-stage diffuser nozzle.

Figure 16A:
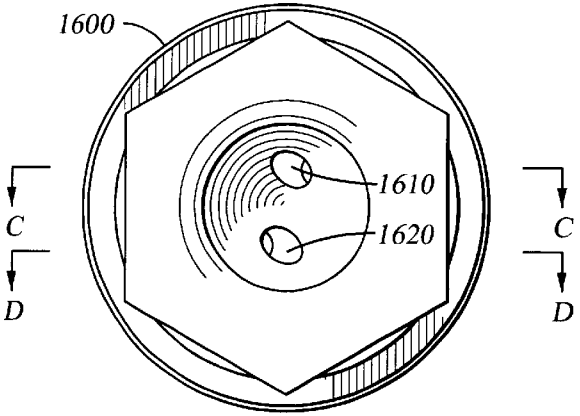
FIGS. 16A–C illustrate angled inlet passages for a multi-stage diffuser nozzle.
Figure 16C:
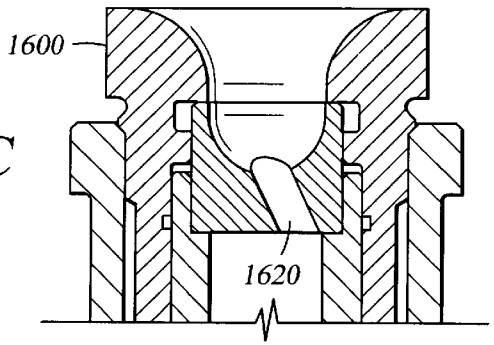
Figure 16B:
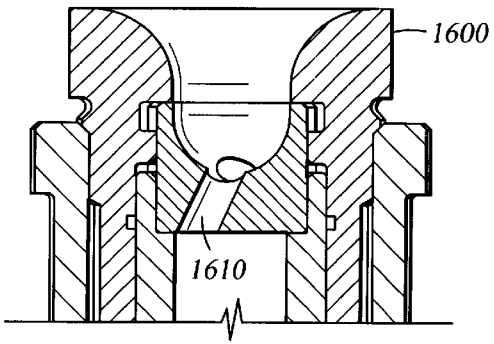

FIGS. 16A–16C illustrate another approach to evenly distributing fluid to the various fluid exit ports. In particular, FIG. 16A illustrates a top view of a multi-stage diffuser nozzle body 1600 having two angled passage entrances 1610 and 1620. FIG. 16B shows nozzle body 1600 forming a first internal passage 1610. FIG. 16C shows nozzle body forming a second internal passage 1620. By angling the inflow into the diffuser nozzle, rotational flow is imparted to the fluid traveling from the plenum and into the diffuser, which further minimizes fluid separation. This minimization of fluid separation results in a more even and reliable flow pattern from the exits of the multi-stage diffuser nozzle. Preferably, this approach is used in conjunction with a transition region to achieve maximum results.

Referring again to FIGS. 4 and 5, there is another aspect to the invention. The flow distributor 36 not only controls the exit velocity of the fluid, but also directs at least a portion of the drilling fluid at an angle away from vertical or the longitudinal axis. As best seen in FIG. 4, the first embodiment of the invention includes four equally-sized exit ports at the bottom of the jet. As best seen from FIG. 5, these exits correspond to an equal number of passages disposed at an angle to the longitudinal axis of the multi-stage diffuser nozzle. By altering the number and angle of the jet exits, drilling fluid may be directed to various locations under the borehole. For example, fluids exiting from the multi-stage diffuser nozzle may now be directed at the cone surfaces without damage to the cones for optimal cleaning. It may also be desirable to angle the drilling fluid from different exit ports at various directions to assist the lifting of cuttings from the bottom of the borehole to the annulus, or to otherwise create and maintain flow zones at the bottom of the borehole. Angling of drilling fluid may also reduce re-circulation of the drilling fluid near the borehole bottom, which tends to interfere with efficient removal of borehole cuttings.

Figure 6:
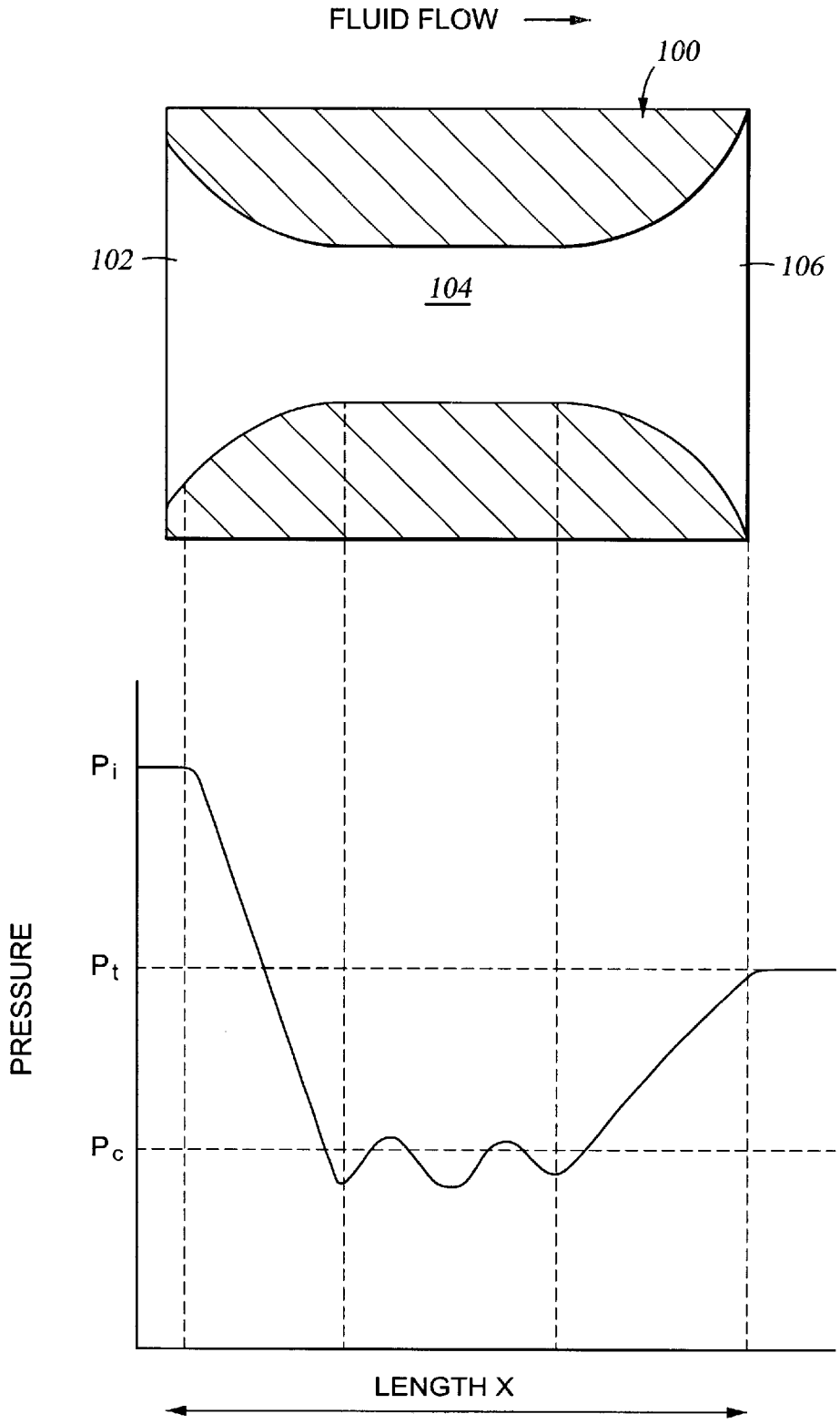
FIG. 6 is a first pressure/distance graph.

FIG. 6 shows an alternate flow restrictor nozzle design 100, and a corresponding pressure level-distance graph. Flow restrictor design 100 includes entrance 102, straight throat channel 104, and exit 106. As is understood by one of ordinary skill in the art, fluid velocity and fluid pressure are inversely related so that as the fluid accelerates and gains velocity as it flows its fluid pressure drops. Thus, prior to entering the entrance 102 of the flow restrictor 100, the pressure of the drilling fluid is at a relatively high pressure, $P_i$. The pressure of the fluid drops precipitously at the entrance 102 from a relatively high, $P_i$, to a much lower choke pressure, $P_c$, corresponding to the straight throat channel 104 of the flow restrictor nozzle. This sudden drop in fluid pressure causes turbulent fluctuations in the drilling fluid, as is shown by the oscillating fluid pressure corresponding to the length of the straight throat channel 104. At the flow restrictor exit, the fluid channel smoothly widens, resulting in a rise in the fluid pressure to an intermediate transition pressure, $P_T$. The total pressure drop across the restrictor 100 is defined as $\Delta P_R = P_i - P_T$.

Figure 7A:
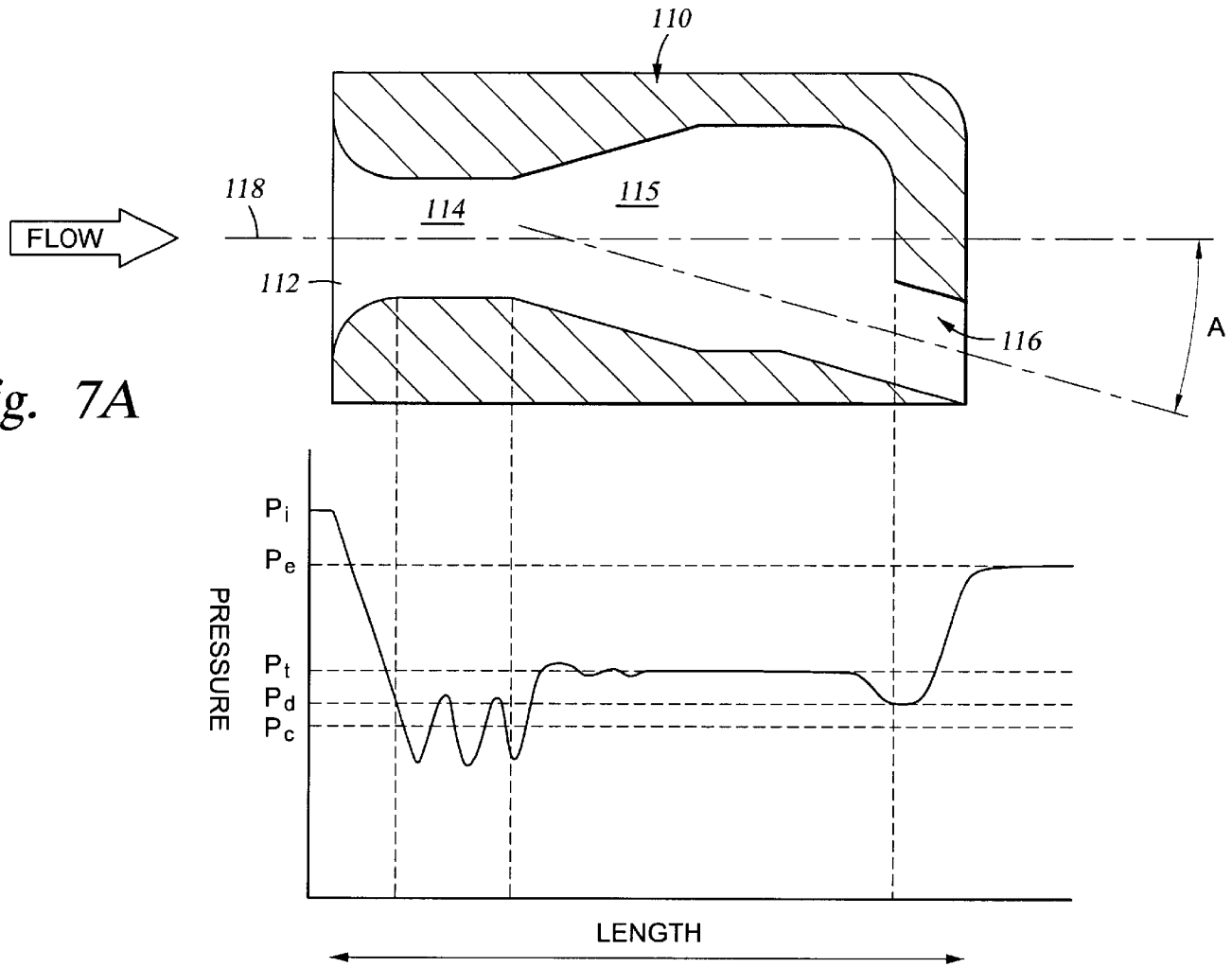
FIG. 7A is a second pressure/distance graph.

FIG. 7A shows a multi-stage diffuser nozzle 110 with longitudinal axis 118, including entrance 112, throat channel 114, transition region 115, and fluidic distributor portion 116. In FIG. 7, only one exit port is explicitly shown, although it is to be understood that other exit ports at some angle to the longitudinal axis are also present. Also shown is a corresponding pressure level-distance graph. As with the flow restrictor of FIG. 6, before flowing into the entrance 112 of the flow restrictor 110, the drilling fluid has an initial pressure, $P_i$, at a relatively high level. The fluid pressure drops precipitously as the fluid enters the throat channel 114 and attains a relatively low choke pressure, $P_c$. The fluid pressure then rises to a transition pressure, $P_t$, as it leaves the throat channel and enters the transition region 115 having a cross-sectional area greater than the cross-sectional area of the throat channel. Transition pressure $P_t$ is a fluid pressure lower than the initial pressure, $P_i$, but higher than the choke pressure, $P_c$. It is while the drilling fluid is in the transition region 115 that the perturbations and fluctuations in the fluid reduce and die down. Upon entering a diffuser exit channel, the fluid pressure drops to a level $P_d$ lower than the transition pressure, but above that of the choke pressure, $P_c$. After leaving the multi-stage diffuser nozzle the fluid pressure rises once again, up to an exit pressure, $P_e$. The total multistage pressure drop is thus defined as $\Delta P_m = P_i - P_e$ where $P_i > P_e$.

Figure 7B:
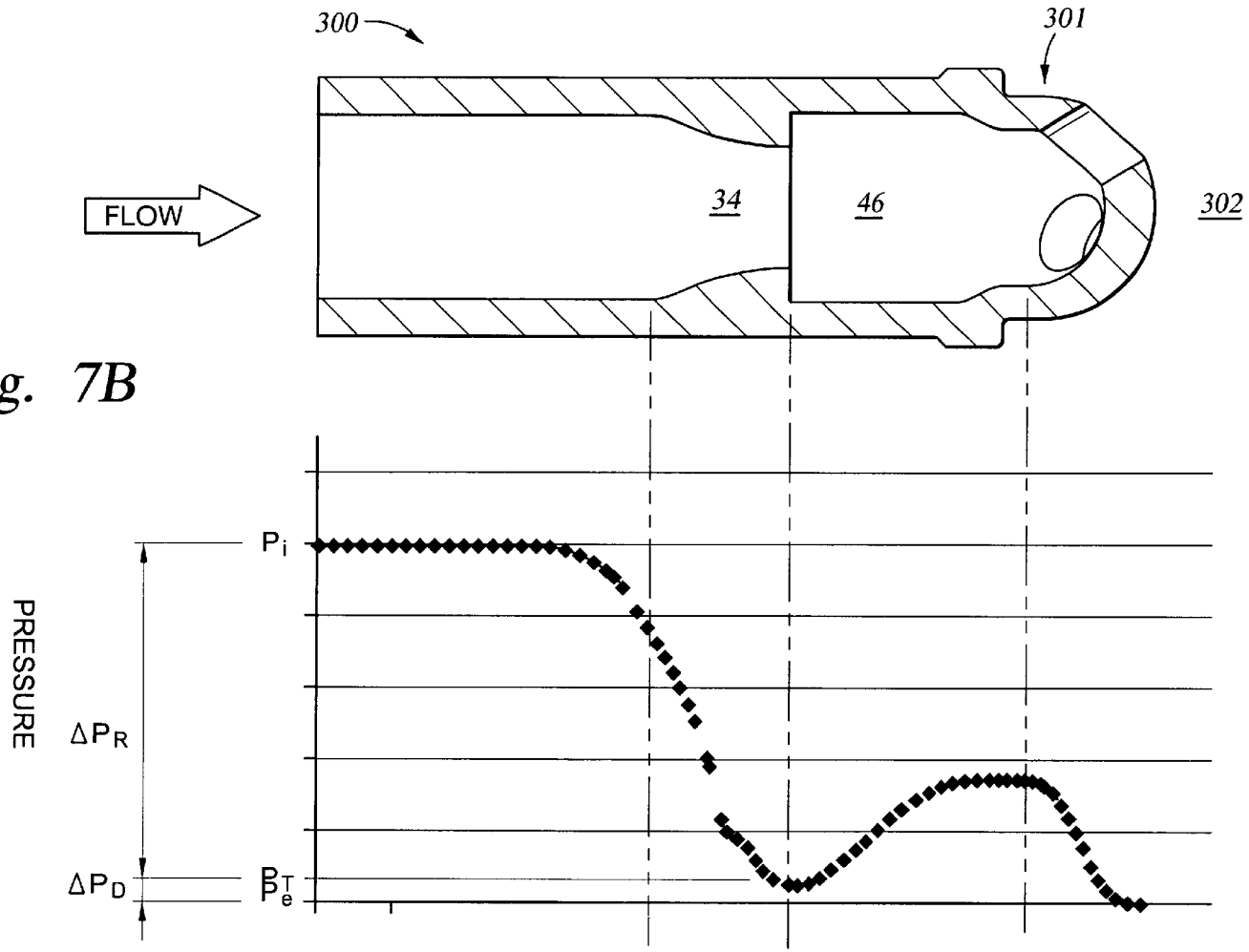
FIG. 7B is a multi-stage diffuser nozzle showing various fluid pressure locations.

Referring to FIG. 7B, the pictured multistage diffuser includes an upper stage 300 and a lower stage 301. The upper stage 300 controls the flow rate through the system. Fluid from the bit plenum 13 enters flow restrictor 34, where it then exits into the nozzle transition region 46. The pressure drop ($\Delta P_R$) across the restricting nozzle 300 is defined as $\Delta P_R = P_i - P_T$. The lower stage 301 is fed from the transition region 46 and exits into the annular space 302 below the dome 17 of the bit. The lower stage 301 is a distribution network that angularly directs drilling fluid to benefit the cleaning of cutting elements on the drill bit and to lower the velocity of the fluid so that it will not erode the adjacent components. The pressure drop across the distribution stage 301 is defined as $\Delta P_D = P_T - P_E$. Desirable choking is being accomplished across the upper section 300 if $\Delta P_R > \Delta P_D$. This should correspond to a lower average velocity at the exit of the lower stage nozzle system 301. As mentioned previously, by measuring $\Delta P_R$ and $\Delta P_D$, each nozzle section can characterized in terms of its effective nozzle size. Assuming that the effective nozzle size of the flow restrictor 34 is $A_{0E}$ and the effective nozzle size of the flow distributor 36 is $A_{1E}$, then desired choking or restricting of the nozzle is accomplished when $A_{0E} < A_{1E}$.

There is therefore a distinct fluid pressure relationship amongst the flow restrictor, the transition region, and the flow distributor portions of a preferred multi-stage diffuser nozzle. In a flow restrictor portion, the drilling fluid undergoes a significant pressure drop, which is followed by a pressure recovery in the transition portion, and which is finally followed by a pressure drop corresponding to the fluidic distributor portion of the nozzle. Given a transition region of sufficient size, oscillations in fluid pressure are reduced significantly or die out prior to the fluid flowing into the multiple exit ports of the fluidic distributor portion. Obviously, this pressure relationship changes somewhat in a multi-stage diffuser nozzle that does not have a transition region or where the transition region is very small.

Numerous variations to these basic designs are possible. Referring now to FIGS. 8A through 8B, an embodiment of the invention is shown that has a unitary (i.e. one-piece) body. FIG. 8A, a bottom view of a multi-stage diffuser nozzle 202, includes three circular exit ports. 210–212, each at a non-central location in a nozzle bottom 208. Exit ports 211–212 are disposed at angles E and D, respectively, as measured with respect to a line running through the centers of the nozzle (as shown in FIG. 8A) and exit port 210. FIG. 8B is taken along line A—A of FIG. 8A, which runs through exit port 210. A multi-stage diffuser nozzle 202 includes a flow restrictor region 220, a transition region 222, and a flow distributor region 224. Flow distributor region 224 is disposed at angle A, about 15 degrees away from centerline. In this embodiment, the flow distributor regions associated with exit ports 211 and 212 are angled about 15 degrees away from centerline as well.

Restrictor region 220 has a throat diameter of $A_0$. The transition zone 222 has a maximum diameter greater than the throat diameter $A_0$. Each exit port 210–212 (one is shown in FIG. 8B) has some (although not necessarily the same) diameter of $A_i$. With n exit ports, $A_0$ and $A_i$ of the invention are related as:

$$A_0 < \sum_{i=1}^{n} A_i \tag{7}$$

In other words, the effective cross-sectional area of the flow restrictor is less than the effective cross-sectional area of the fluidic distributor.

Figure 9B:
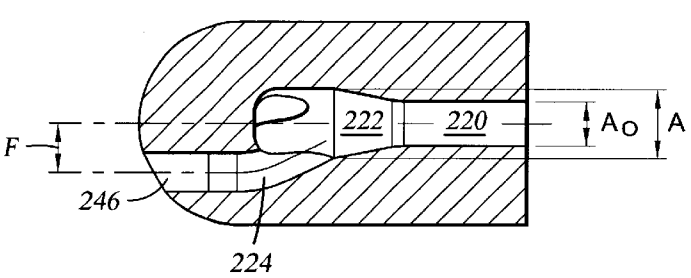
FIGS. 9A–9D are views of another multi-stage diffuser nozzle.
Figure 9D:
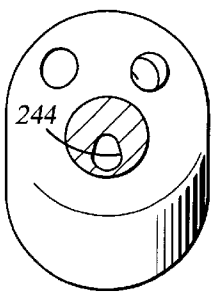
Figure 9A:
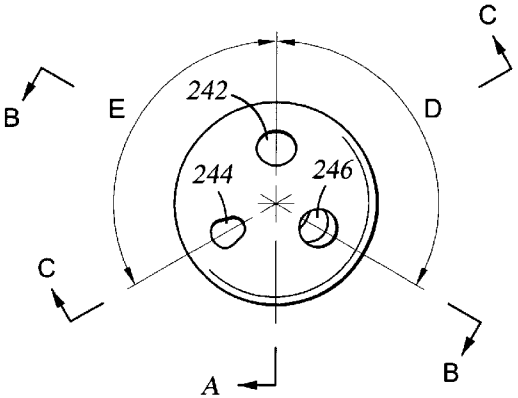
Figure 9C:
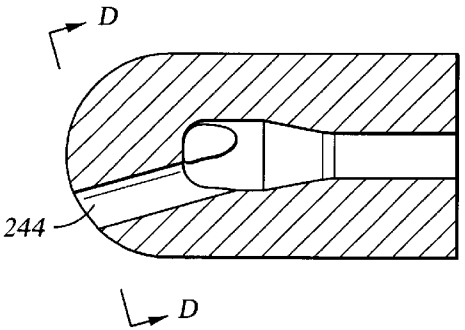

FIG. 9A is a bottom view of a different multi-stage diffuser nozzle. Three exit ports 242, 244, 246 are shown, each at a non-central location. FIG. 9B is taken along line B—B of FIG. 9*a*, and shows an alternate exit port design, including restrictor region throat diameter A, transition zone diameter A, and flow distributor region 224. In this embodiment, the transition region 222 connects to a flow distributor region 224 which comprises, in part curved exit channel, which then itself transitions into a straight channel parallel to the nozzle centerline. FIG. 9C is taken along line C—C of FIG. 9A, shows a flow distributor region having an exit channel and an exit port with non-circular shapes. The non-circular shape of the exit port may be seen more easily from FIG. 9D. Of course, the exit port may be of any suitable shape, including a slit or a square.

FIG. 10A is a bottom view of yet another multi-stage diffuser nozzle. As before, three exit ports 252, 254, and 256, are shown (although any desired number of exit ports may be employed).In this embodiment exit port 256 exits from the side of the multi-stage diffuser nozzle. This side exit port may be most easily seen in FIG. 10B.

Figure 11B:
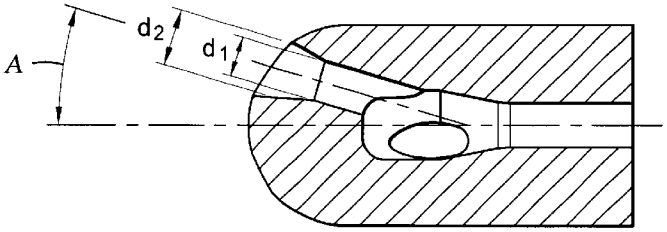
FIGS. 11A and 11B are bottom and cut-away side views of a variation to the multi-stage diffuser nozzle design.
Figure 11A:
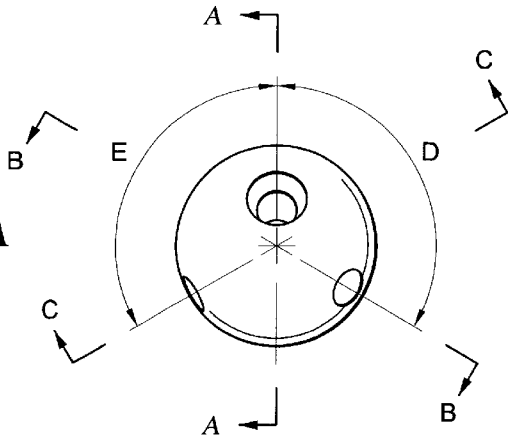

FIG. 11A is a bottom view of a multi-stage diffuser nozzle that has a diffused exit port. Referring to FIG. 11B, taken along line A—A of FIG. 11A, the multi-stage diffuser nozzle includes throat, transition, and fluidic distributor portions. Fluidic distributor portion includes a single exit channel of minimum diameter $d_1$ and an exit diameter $d_2$, with $d_2 > d_1$. This diffusive channel will improve the efficiency of the fluidic distributor and make the effective cross sectional area larger than if no diffusive section were added. The diffusive section will also help to further reduce exit velocity for the drilling fluid. The second and third exit ports have the standard, circular geometry in the pictured embodiment.

Figure 12B:
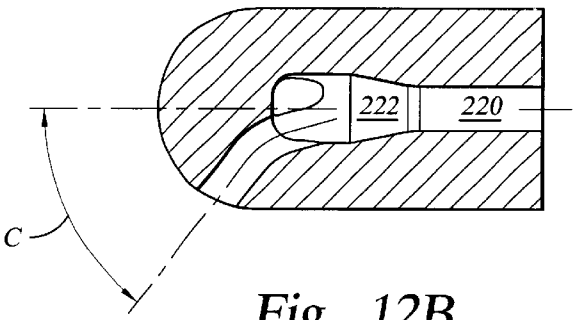
FIGS. 12A and 12B are bottom and cut-away side views of an alternate multi-stage diffuser nozzle.
Figure 12A:
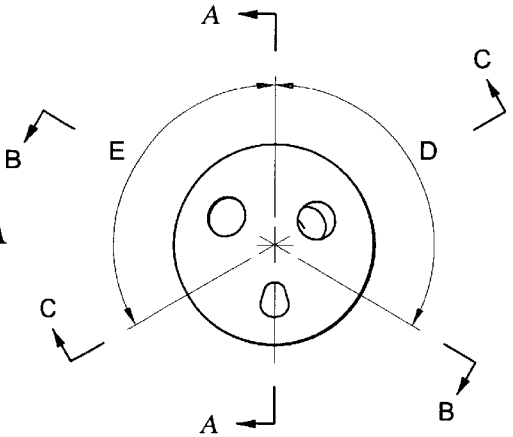

FIG. 12A is a bottom view of a multi-stage diffuser nozzle that has a curved exit channel. Referring to FIG. 12B, the nozzle exit channel connects to transition region 222 and curves outward to an angle "C" from the nozzle centerline.

FIG. 13A is a bottom view of a multi-stage diffuser nozzle that has a combination of the above-described exit channels as part of its flow distributor region 224. FIG. 13B is taken along line B—B of FIG. 13A, and shows an exit channel that branches off from the transition region, and then runs parallel to the nozzle centerline. FIG. 13C is taken along line C—C of FIG. 13A, and includes a curved exit channel. FIG. 13D is taken along line A—A of FIG. 13A, and shows a straight exit channel. The use of different channel and exit port configurations allows for the design of optimal flow regimes that can emphasize different functions such as creation of desirable flow fields to prevent the build up of debris or by utilizing the fluid energy to clean the hole bottom or inserts on the cones.

Figure 15:
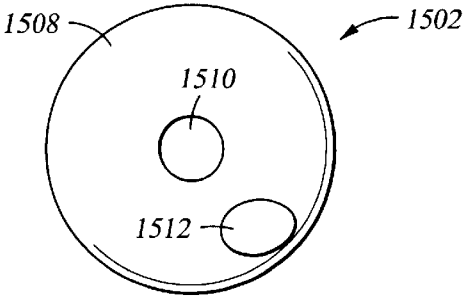
FIG. 15 is a bottom view of a nozzle showing central and non-central exit ports.

Of course, the multi-stage diffuser nozzle can be manufactured to eject drilling fluid at any angle from each exit port, and different angles may be used for different exit ports. FIG. 15, for example, shows a flow restrictor body 1508 having a first exit port 1510 at the centerline of the diffuser nozzle, and a second exit port 1512 disposed at a distance from the central nozzle. Any number of exit ports may be drilled or otherwise formed as part of the fluidic diffuser, and extension nozzles may be added to one or more of the exit ports for any desired purpose, such as to add length or additional ports. The design may even be altered so the purpose of the flow restrictor or fluidic distributor is accomplished by the combined action of multiple passages or channels.

Figure 17:
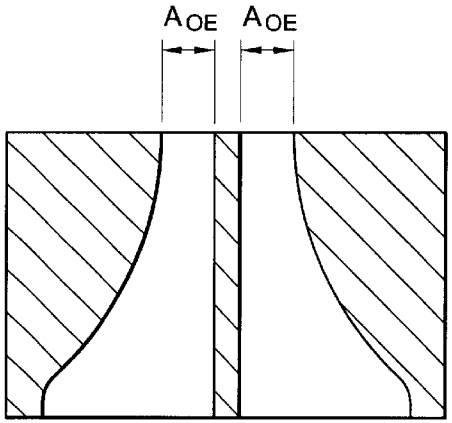
FIG. 17 is a cut away view of a flow restrictor having two flow passages.

FIG. 17 is a cut away view of a flow restrictor having two flow passages.

Figure 18B:
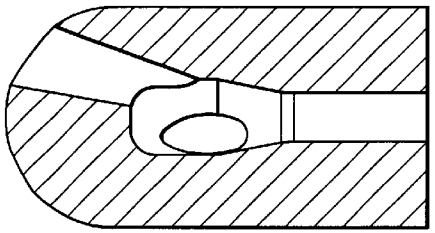
FIGS. 18A–18C are Figures of a multi-stage diffuser nozzle having differently sized exit passages.
Figure 18C:
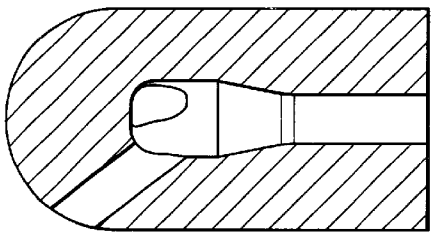
Figure 18A:
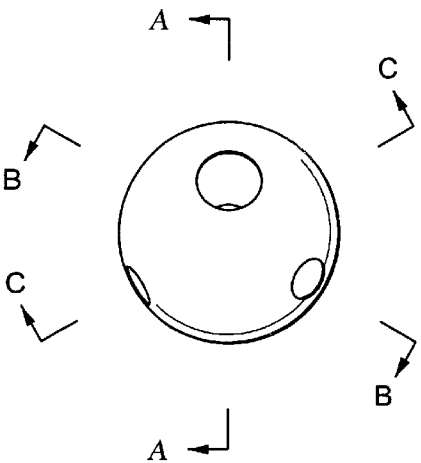

FIGS. 18A–18C are FIGS. of a multi-stage diffuser nozzle having differently sized exit passages.

The multi-stage diffuser nozzle provides the drill bit designer great flexibility. Because the exit velocities of the drilling fluid from the nozzle jets can be reduced significantly, it allows a substantially higher fraction of drilling fluid to be ejected from a center jet if that is what is desired. The fraction of drilling fluid ejected from the peripheral jets may therefore also be controlled. Regardless of whether the principles of the invention are utilized for a center jet or a peripheral jet, the drilling fluid flowing through the multi-stage diffuser nozzle may be split into two or more portions, directed at an angle away from the centerline of the multi-stage nozzle, or otherwise manipulated. For embodiments of the invention that include distinct flow restriction and fluidic distributor components, further flexibility is provided in the field, where a last minute determination can be made economically for the most desirable flow rate and exit velocity.

Another aspect of this invention is the installation of the multi-stage diffuser into the drill bit. While the multi-staged diffuser can be installed into the bit without regard to its orientation relative to the cones, it is preferable that it be installed at an indexed (pre-calculated) position within the body of the bit. Indexing the multi-staged diffuser will ensure that the distribution ports are vectored to the desired locations and will generate the desired effect. This could be done by simply orienting the diffuser to the predetermined position and locking it with the retaining nut through frictional forces. Alternatively, it could be done with indexing pins or grooves that would only allow a single predetermined installation orientation or a set of predetermined installation orientations.

While preferred embodiments of this invention have been shown and described, other modifications can be made to these embodiments by one skilled in the art without departing from the spirit or teaching of this invention. For example, not all of the exit ports are required to be at non-central locations. Also, while the embodiments are shown on roller cone bits, the invention could likewise be used on fixed cutter (PDC) type bits. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A drill bit, comprising:

a drill bit body forming an interior plenum and defining a longitudinal axis, wherein said drill bit body further comprises an outer peripheral surface around said drill bit body;

a multi-stage diffuser nozzle in fluid communication with said interior plenum, said multi-stage diffuser comprising, a flow restrictor component having at least one internal passage to carry fluid, said interior passage having a throat with an effective cross-sectional area $A_{OE}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has an effective cross-sectional area $A_{1E}$ and wherein $A_1E$ is greater than $A_{0E}$, there being a nozzle axis through said multi-stage diffuser nozzle that is parallel to said longitudinal axis, wherein said fluid exit side of said fluidic distributor at a first exit port is disposed to direct at least a portion of said fluid along a path that is non-collinear with said nozzle axis and wherein said multi-stage diffuser nozzle defines a central axis, said central axis of said multi-stage diffuser nozzle at said fluid exit side being located closer to but not along said longitudinal axis than to said outer peripheral surface.

2. A drill bit, comprising:

a drill bit body forming an interior plenum;

a multi-stage diffuser nozzle in fluid communication with said interior plenum, said multi-stage diffuser comprising, a flow restrictor component having at least one internal passage to carry fluid, said interior passage having a throat with an effective cross-sectional area $A_{0E}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has an effective cross-sectional area $A_{1E}$ and wherein $A_{1E}$ is greater than $A_{0E}$ and a fluid transition region between said flow restrictor and said fluidic distributor, said fluid transition region having an effective cross-sectional area $A_{2E}$, wherein $A_{2E}$ is greater than either $A_{1E}$ or $A_{0E}$.

3. A drill bit, comprising:

a drill bit body forming an interior plenum;

a multi-stage diffuser nozzle in fluid communication with said interior plenum, said multi-stage diffuser comprising, a flow restrictor component having at least one internal passage to carry fluid, said interior passage having a throat with an effective cross-sectional area $A_{0E}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has an effective cross-sectional area $A_{1E}$ and wherein $A_{1E}$ is greater than $A_{0E}$ and wherein said fluidic distributor includes at least a first exit port connected to a first fluid channel and a second exit port connected to a second fluid channel, said first fluid channel having a maximum cross-sectional area greater than said second fluid channel.

4. A drill bit, comprising:

a drill bit body forming an interior plenum;

a plurality of multi-stage diffuser nozzles in fluid communication with said interior plenum, each of said multi-stage diffuser comprising, a flow restrictor component having at least one internal passage to carry fluid, said interior passage having a throat with an effective cross-sectional area $A_{0E}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has an effective cross-sectional area $A_{1E}$ and wherein $A_{1E}$ is greater than $A_{0E}$.

5. A drill bit, comprising:

a drill bit body;

a nozzle body attached to said drill bit body, said nozzle body including a first set of one or more passages of a first total physical cross-sectional area at an upper end and a second set of one or more passages of a second total physical cross-sectional area at a lower end, said second set of passages being in fluid communication with said first set of passages, wherein said second total physical cross-sectional area is greater than said first total physical cross-sectional area;

wherein said nozzle body defines a centerline, said first set of passages defining a at least one fluid inlet trajectory and said second set of passages defining at least one fluid discharge trajectory, any one or more of the fluid inlet trajectories or the fluid discharge trajectories being non-collinear with said centerline.

6. The drill of claim 5, said drill bit including an outer peripheral surface and defining a longitudinal axis, wherein said nozzle body is located more proximate said logitudinal axis than said peripheral surface.

7. The drill bit of claim 5, said drill bit including an outer peripheral surface and defining a longitudinal axis, wherein said nozzle body is located more proximate said peripheral surface than said longitudinal axis.

8. The drill bit of claim 5, wherein said fluid discharge trajectory is parallel to said centerline.

9. The drill bit of claim 5, wherein said first set passages is a single passage.

10. The drill bit of claim 5, wherein said second set of passages is a single passage.

11. The drill bit of claim 5, wherein said first set of passages is at least two passages.

12. The drill bit of claim 5, wherein said second set of passages is at least two passages.

13. The drill bit of claim 5, wherein said second set of passages define at least two fluid discharge trajectories.

14. The drill bit of claim 13, wherein none of said at least two discharge trajectories is collinear with said centerline.

15. The drill bit of claim 5, wherein said nozzle body further comprises a fluid transition region between said first set of passages and said second set of passages, said transition region having a maximum cross-sectional area greater than either of said first total cross-sectional area or said second total cross-sectional area.

16. The drill bit of claim 5, wherein at least one of said first set of passages has a varying cross-section along its length.

17. The drill bit of claim 5, wherein at least one of said second set of passages has a varying cross-section along its length.

18. The drill bit of claim 5, wherein said second set of passages includes at least first and second passages having different cross-sectional areas.

19. The drill bit of claim 5, wherein the effective cross-sectional area of said second set of passages is greater than the effective cross-sectional area of said first set of passages.

20. The drill bit of claim 5, further comprising a second nozzle body.

21. The drill bit of claim 5, wherein said drill bit is a roller cone rock bit.

22. The drill bit of claim 5, wherein said drill bit is a fixed cutter drag bit.

23. The drill bit of claim 5, wherein the at least one fluid inlet trajectory is non-collinear with said centerline.

24. The drill bit of claim 5, wherein the at least one fluid discharge trajectory is non-collinear with said centerline.

25. A method of controlling fluid flow through a drill bit, comprising:

a) lowering the fluid pressure of drilling fluid flowing through said drill bit from an initial pressure to a choke pressure wherein said drilling fluid is of said initial pressure while occupying a fluid plenum formed in the interior of said drill bit;

b) raising said fluid pressure from said choke pressure to a transition pressure, said transition pressure being less than said initial pressure;

c) dampening fluid pressure oscillations in said drilling fluid, wherein said dampening step stabilizes said fluid pressure at said transition pressure; and d) altering said fluid pressure to an exit pressure, said exit pressure being higher than said choke pressure.

26. A method of controlling fluid flow through a drill bit, comprising:

a) lowering the fluid pressure of drilling fluid flowing through said drill bit from an initial pressure to a choke pressure;

b) raising said fluid pressure from said choke pressure to a transition pressure, said transition pressure being less than said initial pressure; and c) dampening fluid pressure oscillations in said drilling fluid, wherein said dampening step stabilizes said fluid pressure at said transition pressure; and d) altering said fluid pressure to an exit pressure, said exit pressure being higher than said choke pressure and wherein the difference between said initial pressure and said transition pressure is greater than the difference of said transition pressure and said exit pressure.

27. A drill bit, comprising:

a drill bit body forming an interior plenum and defining a longitudinal axis;

a multi-stage diffuser nozzle in fluid communication with said interior plenum, said multi-stage diffuser comprising, a flow restrictor component having at least one internal passage to carry fluid, said at least one internal passage having a throat with an physical cross-sectional area $A_{0P}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has a physical cross-sectional area $A_{1P}$ and wherein $A_{1P}$ is greater than $A_{0P}$, there being a nozzle axis through said multi-stage diffuser nozzle that is parallel to said longitudinal axis, wherein said fluid exit side of said fluidic distributor at a first exit port is disposed to direct at least a portion of said fluid along a path that is non-collinear with said nozzle axis.

28. A multi-stage diffuser nozzle, comprising:

means for lowering fluid pressure from an initial pressure to a choke pressure;

means for raising said choke pressure to a transition pressure;

means for lowing the transition pressure to a diffuser channel pressure;

means for altering said diffuser channel pressure to an exit pressure higher than said choke pressure and lower than said initial pressure, wherein the difference between said initial pressure to said transition pressure is greater than the difference between said transition pressure and said exit pressure, said means for altering said fluid pressure directing fluid at a non-zero angle to a longitudinal axis running through said multi-stage diffuser nozzle.

29. A multi-stage nozzle for use with a drill bit, compromising:

a flow restrictor having an internal passage to carry fluid, said interior passage having a throat with an effective cross-sectional area $A_{0E}$; and a fluidic distributor, said fluidic distributor having at least one fluid entrance port connected to at least one fluid exit port, said at least on fluid entrance port being in fluid communication with said interior passage of said flow restrictor, wherein said fluidic distributor presents an effective cross-sectional area $A_{1E}$ to said fluid, said effective cross-sectional area $A_{1E}$ being greater than said effective cross-sectional area $A_{0E}$;

a fluid transition region between said flow restrictor and said fluidic distributor, said fluid transition region having an effective cross-sectional area $A_{2E}$ greater than either $A_{1E}$ or $A_{0E}$ wherein said at least one fluid exit port ejects at least a portion of said fluid at a non-parallel angle to a longitudinal axis defined by said drill bit.

30. The nozzle of claim 29, wherein said flow restrictor, said fluidic distributor, and said fluid transition region are manufactured from a single component.

31. The nozzle of claim 29, wherein said flow restrictor, said fluidic distributor, and said fluid transition region are manufactured from multiple components.

32. A drill bit, comprising:

a drill bit body forming an interior plenum;

a multi-stage diffuser nozzle in fluid communication with said interior plenum, said multi-stage diffuser comprising, a flow restrictor component having at least one internal passage to carry fluid, said interior passage having a throat with an effective cross-sectional area $A_{0E}$; and p2 a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has an effective cross-sectional area $A_{1E}$ and wherein $A_{1E}$ is greater than $A_{0E}$;

a second multi-stage diffuser nozzle in fluid communication with said interior plenum, said second multi-stage diffuser nozzle being completely distinct from said first multi-stage diffuser nozzle, said second said multi-stage diffuser comprising, a second flow restrictor component having at least one internal passage to carry fluid, said interior passage of said second flow restrictor having a throat with an effective cross-sectional area $A_{2E}$; and a second fluidic distributor component distinct from said second flow restrictor component, said second fluidic distributor having a fluid entrance side connected to a fluid exit side, said fluid entrance side of said second fluidic distributor component being in fluid communication with said interior passage of said second flow restrictor, wherein said fluid exit side of said second fluidic distributor component having an effective cross-sectional area $A_{3E}$ and wherein $A_{3E}$ is greater than $A_{2E}$.

33. The drill bit of claim 32, wherein $A_{0E}$ and $A_{2E}$ are not the same.

34. The drill bit of claim 32, wherein $A_{1E}$ and $A_{2E}$ are not the same.

35. The drill bit of claim 32, wherein $A_{0E}$ and $A_{2E}$ are not the same and wherein $A_{1E}$ and $A_{3E}$ are not the same.

36. A drill bit, comprising:

a drill bit body;

a nozzle body attached to said drill bit body, said nozzle body including a first set of one or more passages of a first total physical cross-sectional area at an upper end and a second set of one or more passages of a second total physical cross-sectional area at a lower end, said second set of passages being in fluid communication with said first set of passages, wherein said second total physical cross-sectional area is greater than said first total physical cross-sectional area;

wherein said nozzle body defines a centerline, said first set of passages defining a at least one fluid inlet trajectory and said second set of passages defining at least one fluid discharge trajectory, any one or more of the fluid inlet trajectories or the fluid discharge trajectories being non-collinear with said centerline;

a second nozzle body attached to said drill bit body, said second nozzle body including a third set of one or more passages of a third total physical cross-sectional area at an upper end and a fourth set of one or more passages of a fourth total physical cross-sectional area at a lower end, said fourth set of passages being in fluid communication with said third set of passages, wherein said fourth total physical cross-sectional area is greater than said third total physical cross-sectional area;

wherein said second nozzle body defines a second centerline, said third set of passages defining a at least one fluid inlet trajectory and said fourth set of passages defining at least one fluid discharge trajectory, any one or more of the fluid inlet trajectories or the fluid discharge trajectories of said second nozzle body being non-collinear with said second centerline.

37. The drill bit of claim 36, wherein said first total physical cross-sectional area differs from said third total physical cross-sectional area.

38. The drill bit of claim 36, wherein said third total physical cross-sectional area differs from said fourth total physical cross-sectional area.

39. A drill bit, comprising:

a drill bit body defining a bit body longitudinal axis and including an outer periphery;

a multi-stage diffuser nozzle attached to said drill bit body, for directing drilling fluid from said drill bit body to a selected location, said nozzle comprising an upper restrictor portion having an effective internal cross-sectional area of $A_{0E}$;

a lower distributor portion having an effective internal cross-sectional area of $A_{1E}$, where effective area $A_{1E}$ is greater than effective area $A_{0E}$;

wherein said multi-diffuser nozzle defines a nozzle longitudinal axis and said lower distributor portion directs at least a portion of said drilling fluid along a trajectory other than along said nozzle longitudinal axis;

a second multi-stage diffuser nozzle attached to said drill bit body, said second multi-stage diffuser nozzle directing drilling fluid from said drill bit body to a second selected location, said second nozzle comprising an upper restrictor portion having an effective internal cross-sectional area of $A_{2E}$;

a lower distributor portion having an effective internal cross-sectional area of $A_{3E}$, where effective area $A_{3E}$ is greater than effective area $A_{2E}$;

wherein said second multi-diffuser nozzle defines a nozzle longitudinal axis and said lower distributor portion directs at least a portion of said drilling fluid along a trajectory other than along said second nozzle longitudinal axis.

40. The drill bit of claim 39, wherein cross-sectional area $A_{0E}$ is not the same as cross-sectional area $A_{2E}$.

41. The drill bit of claim 39, wherein cross-sectional area $A_{1E}$ is not the same as cross-sectional area $A_{3E}$.

42. The drill bit of claim 39, wherein cross-sectional area $A_{0P}$ is not the same as cross-sectional area $A_{2P}$.

43. The drill bit of claim 39, wherein cross-sectional area $A_{1P}$ is not the same as cross-sectional area $A_{3P}$.

44. A drill bit, comprising:

a drill bit body forming an interior plenum;

a multi-stage diffuser nozzle in fluid communication with said interior plenum, said multi-stage diffuser comprising, a flow restrictor component having at least one internal passage to carry fluid, said at least one internal passage having a throat with an physical cross-sectional area $A_{0P}$; and a fluidic distributor component distinct from said flow restrictor component, said fluidic distributor having a fluid entrance side connected to a fluid exit side, said fluid entrance side being in fluid communication with said interior passage of said flow restrictor, wherein said fluid exit side has a physical cross-sectional area $A_{1P}$ and wherein $A_{1P}$ is greater than $A_{0P}$;

a second multi-stage diffuser nozzle in fluid communication with said interior plenum, said second multi-stage diffuser comprising, a flow restrictor component having at least one internal passage to carry fluid, said at least one internal passage having a throat with an physical cross-sectional area $A_{2P}$; and a fluidic distributor component distinct from said flow restrictor component of said second multi-stage diffuser, said fluidic distributor of said second multi-stage diffuser having a fluid entrance side and a fluid exit side, said fluid entrance side of said second multi-stage diffuser being in fluid communication with said interior passage of said flow restrictor, wherein said fluid exit side of said second multi-stage diffuser has a physical cross-sectional area $A_{3P}$ and wherein $A_{3P}$ is greater than $A_{2P}$.

* * * * *